US011946328B2

(12) United States Patent
Bruandet

(10) Patent No.: US 11,946,328 B2
(45) Date of Patent: Apr. 2, 2024

(54) DOWN THE HOLE DRILLING ASSEMBLY EXHAUST ASSEMBLY

(71) Applicant: SANDVIK MINING AND CONSTRUCTION OY, Tampere (FI)

(72) Inventor: Olivier Bruandet, Tampere (FI)

(73) Assignee: Sandvik Mining and Construction Oy, Tampere (FI)

( * ) Notice: Subject to any disclaimer, the term of this patent is extended or adjusted under 35 U.S.C. 154(b) by 341 days.

(21) Appl. No.: 17/619,308

(22) PCT Filed: Jun. 18, 2020

(86) PCT No.: PCT/EP2020/066860
§ 371 (c)(1),
(2) Date: Dec. 15, 2021

(87) PCT Pub. No.: WO2020/254458
PCT Pub. Date: Dec. 24, 2020

(65) Prior Publication Data

US 2022/0098943 A1 Mar. 31, 2022

(30) Foreign Application Priority Data

Jun. 20, 2019 (EP) ..... 19181470

(51) Int. Cl.
*E21B 21/18* (2006.01)
*E21B 4/14* (2006.01)

(52) U.S. Cl.
CPC ..... *E21B 21/18* (2013.01); *E21B 4/14* (2013.01)

(58) Field of Classification Search
CPC ..... E21B 21/18; E21B 4/14
See application file for complete search history.

(56) References Cited

U.S. PATENT DOCUMENTS

| | | | |
|---|---|---|---|
| 8,302,707 | B2 | 11/2012 | Lyon et al. |
| 2010/0059284 | A1 | 3/2010 | Lyon et al. |
| 2010/0200301 | A1 | 8/2010 | Lyon et al. |
| 2012/0006598 | A1 | 1/2012 | Lyon et al. |
| 2012/0261151 | A1 | 10/2012 | In et al. |
| 2013/0186692 | A1 | 7/2013 | Purcell et al. |

FOREIGN PATENT DOCUMENTS

| | | | |
|---|---|---|---|
| CN | 104278949 | A | 1/2015 |
| EP | 3409878 | A1 | 12/2018 |
| WO | 2018107305 | A1 | 6/2018 |
| WO | 2018220098 | A1 | 12/2018 |

*Primary Examiner* — Michelle Lopez
(74) *Attorney, Agent, or Firm* — Corinne R. Gorski

(57) ABSTRACT

A down the hole drilling assembly having a drill tube adapter, an elongate casing, a fluid powered piston, a top working chamber, a bottom working chamber, a top sub and an exhaust system, wherein the exhaust system is moveable with respect to the drill string. The top sub includes an exhaust valve arranged for opening and closing the connection between the at least one exhaust passage and the at least one exhaust port.

13 Claims, 5 Drawing Sheets

DOWN THE HOLE DRILLING ASSEMBLY EXHAUST ASSEMBLY

RELATED APPLICATION DATA

This application is a § 371 National Stage Application of PCT International Application No. PCT/EP2020/066860 filed Jun. 18, 2020 claiming priority to EP 19181470.6 filed Jun. 20, 2019.

TECHNICAL FIELD

This invention relates to a percussive drilling assembly and in particular, although not exclusively, to a down-the-hole hammer exhaust assembly.

BACKGROUND OF THE INVENTION

Holes can be drilled in rock by means of various rock drilling assemblies. Drilling may be performed with a method of combining percussions and rotation. This type of drilling is called percussive drilling. Percussive drilling may be classified according to whether an impact device is outside the drill hole or in the drill hole during drilling. When the impact device is in the drill hole, the drilling is typically called down the hole (DTH) drilling. Since the impact device in the DTH drilling assembly is located inside the drill hole, the structure of the impact device needs to be compact.

The technique of DTH percussive hammer drilling involves the supply of a pressurised fluid via a drill string to a drill bit located at the bottom of a bore hole. The fluid acts to both drive the hammer drilling action and to flush dust and fines resultant from the cutting action rearwardly through the bore hole so as to optimise forward cutting.

The drilling assembly is provided with a reciprocating percussion piston, which is moved by controlling the feeding and discharging of pressurized fluid into and out of working chambers where the working surfaces of the piston are located. The piston is configured to strike a drill bit being connected directly to the drilling assembly. Typically, the piston has two end surfaces that are exposed to working air volumes (a return volume and a drive volume) that are filled and exhausted with each cycle of the piston. The return volume pushes the piston away from its impact point and the drive volume accelerates the piston towards its impact point.

Conventionally, DTH percussive hammers combine the exhausting air from the working air volumes into a central exhaust gallery that delivers all the exhausting air through the drill bit to the exterior of the drilling assembly. The problem with this is that much more air than needed to clean the hole and remove the cutting is passed through the drill bit and along the exterior of the hammer. As the air also contains solids from the drill cuttings this leads to excessive wear rates of the external parts of the DTH hammer assembly and back pressure in the DTH hammer assembly which reduces the tool's overall power and performance.

U.S. Pat. No. 8,302,707 B2 provides an alternative construction whereby the working volumes of air are exhausted from at least one exhaust port to the exterior through the casing wall at the top end of the drilling assembly through an exhaust system. However, the problem with this construction is that the exhaust port is always open which means that during the flushing of the air there is a risk that the pressure becomes unbalanced, which can lead to the hammer flooding. If the hammer floods it has to be removed from the drill rig to be opened and then cleaned up, therefore resulting in a loss of production time. Typically, there would be a check valve on the exhaust port, however the check valve often gets contaminated with dirt or water which leads to malfunction of the check valve. Accordingly, there exists a need for a DTH hammer construction with an improved exhaust system where the air is exhausted from the top of the hammer but without the problems of contamination.

SUMMARY

It is an objective of this invention to provide a novel and improved percussive drilling assembly and apparatus for drilling rock whereby the flushing air is exhausted in a manner in which air is exhausted to minimize wear on the external parts of the assembly, this will improve the lifetime of the drilling assembly and reduce the production down time needed to replace worn parts. It is a further objective to exhaust the air without the issue of contamination of the hammer which will improve the reliability of the drilling assembly.

The objective is achieved by providing a down the hole drilling assembly having a top end arranged for coupling to a drill string and a bottom cutting end, the drilling assembly comprising:

a drill tube adapter positioned at the top end of the assembly;

an elongate casing;

a drill bit at least partially accommodated within the bottom end of the casing;

a fluid powered piston arranged moveably inside the casing which is capable of shuttling axially back and forth;

a top working chamber at the top end side of the piston;

a bottom working chamber at the bottom end side of the piston;

a top sub comprising a retaining shoulder, a plurality of splines, at least one exhaust passage which is engaged to the casing, wherein the at least one exhaust passage is connected to the top chamber via at least one top vent passage;

at least one flushing port at the bottom end of the casing which is connected to the at least one bottom vent passage arranged to vent the bottom chamber;

an exhaust system at the top end of the casing comprising an exhaust cover and at least one exhaust port arranged to vent the top chamber via the at least one exhaust passage;

characterized in that:

the exhaust system is moveable with respect to the drill string and the top sub comprises an exhaust valve which is capable of opening and closing the connection between the at least one exhaust passage and the at least one exhaust port.

Advantageously, this means that when the drilling assembly is in drilling mode the at least one exhaust port is open so that the air from the top chamber is exhausted at the top end of the drilling assembly through the exhaust system and the air from bottom chamber is exhausted through the drill bit to remove the cuttings. This is beneficial as it reduces the air flow passing over the casing (i.e. it reduces the bailing velocity), meaning that the wear of the casing is reduced which increases the service life of the drilling assembly. When the drilling assembly is in flushing mode, i.e. when the drill string is pulled out, the exhaust ports at the top end of the drilling assembly are closed and therefore all the flushing air is directed through the drill bit. This is beneficial as it improves the efficiency of the hole cleaning and reduces the risk of contamination of the hammer from dirt and water. Further, this reduces the risk of unbalanced pressure being created in the hammer which could cause flooding and therefore reduce the reliability of the hammer.

The position of the exhaust valve is controlled by the position of the hammer, no springs or elastic elements are required, therefore improving the reliability of the system. With this construction it is also possible to control the position of the hammer with the pressurized fluid by switching to flushing mode. When the air is turned on, it will apply force on the exhaust system that pushes the hammer into its flushing position.

In one embodiment, the exhaust valve is positioned such that the connection between the at least one exhaust passage and the at least one exhaust port is open when the drilling assembly is in drilling mode.

This has the advantage of reducing the wear of the outer components of the drilling assembly during drilling.

In one embodiment, the exhaust valve is positioned such that the connection between the at least one exhaust passage and the at least one exhaust port is closed when the drilling assembly is in flushing mode.

Advantageously, when in flushing mode all the air is directed through the drill bit which improves the effectiveness of the hole cleaning and prevents contamination of the hammer.

In one embodiment, there is an engaging feature, such as a spline connection, between the exhaust cover and the top sub that allows the exhaust cover and top sub to slide longitudinally between a first position and a second position.

This construction means that torque can be transmitted from the exhaust cover to the top sub and so the position of the top sub moves with respect to the position of the drill string automatically as the drilling assembly is switched between drilling and flushing modes. Advantageously, this means that no manual operation is required. As the drilling assembly is pulled out and retracted the top sub will automatically switch from its first position to its second position and vice versa. No manual operation required to move the exhaust valve so that it is able to open or close the connection between the at least one exhaust port and the at least one exhaust passage.

In one embodiment, there is at least one seal located on both sides of the at least one exhaust port.

Advantageously, the seals ensure that contamination does not enter the hammer. Preferably, the seals are scrapper type or wiper seals. Preferably, the seals are attached to the exhaust cover and act on the surface of the top sub, therefore forming a tight seal either side of the at least one exhaust port and thus preventing contaminants such as dust, dirt and debris from entering the system.

In one embodiment, there is a minimum of 3 seals. The seals are placed so that in both drilling and flushing positions, both the exhaust port and the flushing channel are sealed off from the outside. Advantageously, this means that a very secure and reliable seal is formed to prevent contamination entering the hammer.

In one embodiment, there is a damping device positioned between the top sub and the drill tube adapter.

Advantageously, the damping device will absorb and reduce stress reflected from the drilling operation, therefore protecting the drill string from damage and particularly the rotation unit. The damping device or element could for example be made of an elastomer material. This will help to reduce vibrations in the drilling tubes and protect the rotation unit from harmful stresses caused by recoil. In this embodiment the splines are lubricated as the air is exhausted and there is initially a gap between the top sub and the exhaust cover when in the drilling position. Lubricating the splines helps to prevent galling (seizing) by reducing the friction coefficient between the surfaces and also the air flow helps to cool down the contact temperature therefore minimizing the risks of surface damage.

In one embodiment, the top sub has a guidance feature. Preferably, the guidance feature comprises a first bearing surface and a second bearing surface which are separated from each other. Preferably, the first bearing surface is above the retaining shoulder.

Advantageously, the guidance feature ensures that the exhaust valve remains correctly aligned so that it is able to either fully open or close the connection between the at least one exhaust passage and the at least one exhaust port when switching between drilling and flushing modes respectively. Therefore, ensuring that during flushing there is no contamination of the hammer and more effective cleaning is possible.

In one embodiment, there is a groove in the exhaust cover surrounding the at least one exhaust port. Preferably, the groove extends beyond both ends of the at least one exhaust port. The advantage of the groove is that is creates more space at the opening of the at least one exhaust port which reduces the level of flow resistance in the system. A further advantage is that the exhaust ports are not in direct contact with the wall of the hole being drilled which protects the exhaust port from getting blocked with dirt and debris during the drilling operation. Preferably, the groove has a curved radius as this prevents dirt getting trapped.

In one embodiment, the angle of the exhaust port is inclined at an angle of ≥90° with respect to the longitudinal axis of the drilling assembly that is oriented towards the drill bit. In other words, ≥90° from the vector A referring to FIG. 3. The inclination of the exhaust ports helps to streamline the flow upwardly, therefore reducing the flow resistance. The initial upward boost in velocity to the flow assists with transporting the cuttings out of the hole.

In one embodiment, the fluid is fed to and is discharged from the working chambers via a plurality of fluid passages that are formed between the inner surface of the casing and the outer surface of the control sleeve. Advantageously, the exhaust system as described herein could be implemented in a drilling machine with a solid piston design, such as that disclosed in patent application EP 3 409 878.

Optionally, there is a check valve between the top chamber and the exhaust port. Preferably, the check valve is made from a deformable rubber or with a spring. The addition of the check valve has the advantage of preventing contamination of the hammer.

Another aspect of this invention is a drilling apparatus for percussive rock drilling comprising:

a drill string formed from a plurality of end-to-end coupled drill tubes; and a drilling assembly as described hereinbefore which is releasably attached at an axially forward end of the drill string.

BRIEF DESCRIPTION OF THE DRAWING

A specific implementation of the present invention will now be described, by way of example only, and with reference to the accompanying drawings in which.

DETAILED DESCRIPTION

Figure 1:
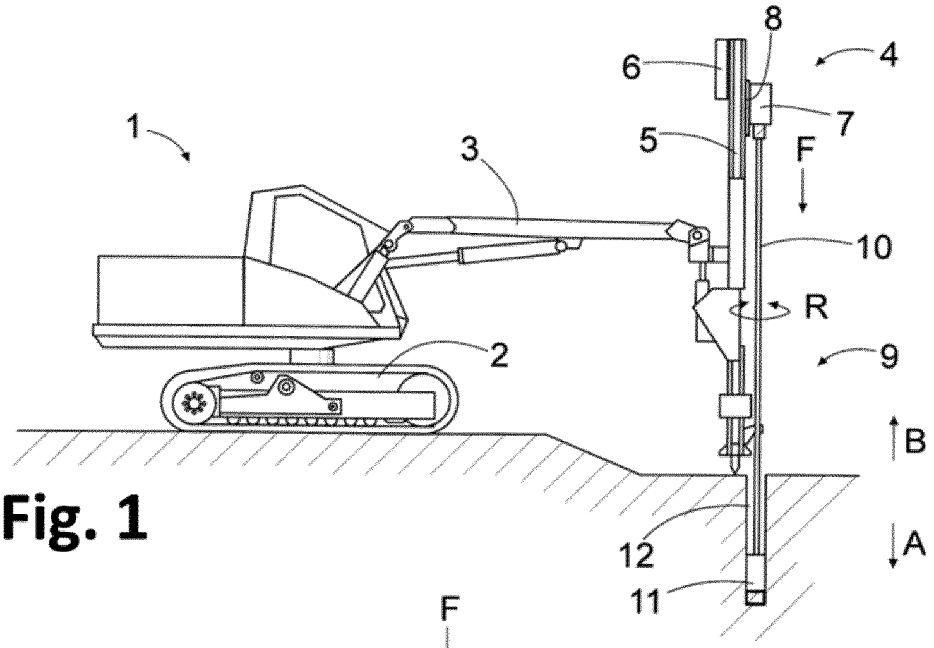
FIG. 1: shows a schematic drawing of a rock drilling rig provided with a DTH rock drilling assembly.

FIG. 1 shows a rock drilling rig 1 that comprises a movable carrier 2 provided with a drilling boom 3. The boom 3 is provided with a rock drilling unit 4 comprising a feed beam 5, a feed device 6 and a rotation unit 7. The rotation unit 7 may comprise a gear system and at least one rotating motor. The rotation unit 7 may be supported by a carriage 8 with which it is movably supported to the feed beam 5. The rotation unit 7 may be provided with drill string 9 which may comprise at least one drilling tube 10 connected to each other, and a DTH drilling assembly 11 at an outermost end of the drilling equipment 9. The DTH drilling assembly 11 is located in the drilled bore hole 12 during the drilling.

Figure 2:
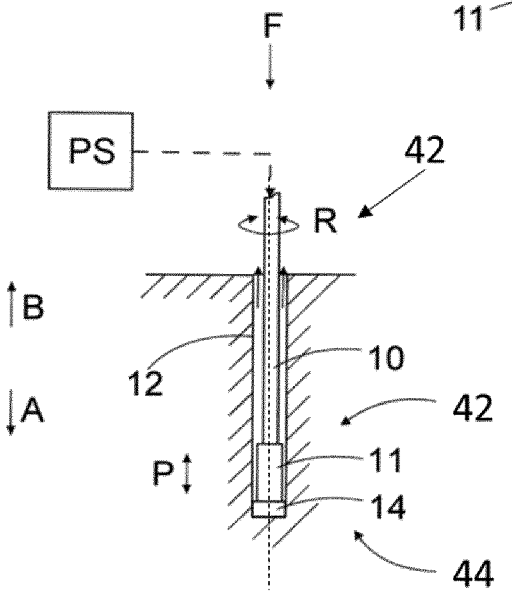
FIG. 2: shows a schematic drawing of a DTH drilling assembly at the bottom of a drill hole.

FIG. 2 shows that the DTH drilling assembly 11 comprises an impact device (not shown). The DTH assembly 11 is cylindrical in shape and has a central axis 2. The impact device is at the opposite end of the drill string 9 in relation to the rotation unit 7. During drilling, a drill bit 14 is connected directly to the impact device, whereby percussions P generated by the impact device are transmitted to the drill bit 14. The drill bit 14 is at least partially accommodated within the bottom end 44 of the casing 15. The drill string 9 is rotating around its longitudinal axis in direction R by means of the rotation unit 7 shown in FIG. 1 and, at the same, the rotation unit 7 and the drill string 9 connected to it are fed with feed force F in the drilling direction A by means of the feed device 6. Then, the drill bit 14 breaks rock due to the effect of the rotation R, the feed force F and the percussion P. Pressurized fluid is fed from a pressure source PS to the drilling assembly 11 through the drilling tubes 10. The pressurized fluid may be compressed air and the pressure source PS may be a compressor. The pressurized fluid is directed to influence to working surfaces of a percussion piston 19 of the drilling assembly and to cause the piston 19 to move in a reciprocating manner and to strike against impact surface of the drill bit 14.

FIG. 2 indicates a top end 42 or axially rearward end of the drilling assembly 11 and bottom end 44 or axially forward end of the drilling assembly.

Figure 3:
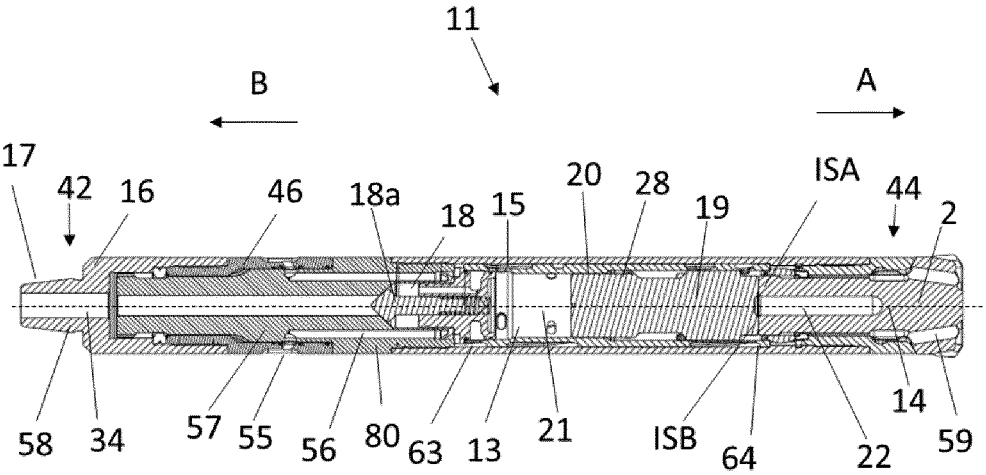
FIG. 3: shows a schematic drawing of a cross section of a DTH drilling assembly when in drilling mode.
Figure 4:
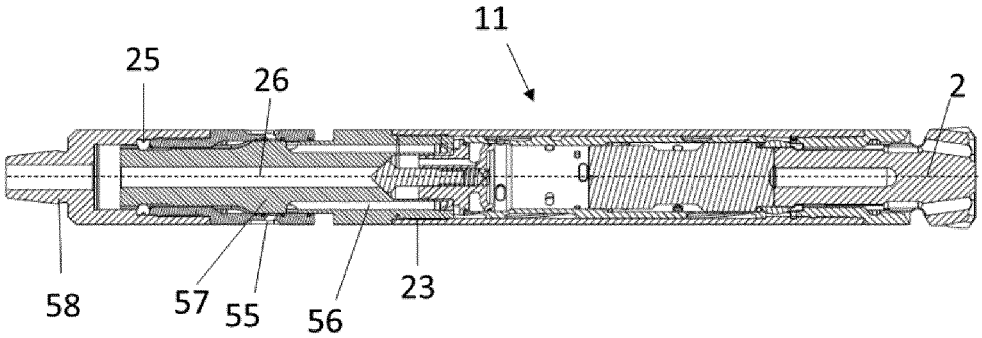
FIG. 4: shows a schematic drawing of a cross section of a DTH drilling assembly when in flushing mode.

FIGS. 3 and 4 show a cross section of the drilling assembly 11 in drilling and flushing modes respectively. In these figures the drilling assembly 11 is shown to have a solid piston 19 design as described in more detail in patent application EP 3 409 878, it should however be understood that the exhaust assembly disclosed herein could be applied to any other type of DTH drilling assembly construction. The drilling assembly 11 comprises an elongate casing 15, which may be a relatively simple sleeve-like frame piece in the form of a substantially hollow cylinder. At a top end 42 of the casing 15 is mounted a top sub (or connection piece) 80 by means of which the drilling assembly 11 can be connected to a drill tube (not shown). The top sub 80 is at least partially accommodated within the top end 42 of the casing 15. The top sub 80 may comprise a threaded connecting surface 23. A drill tube adapter 16 comes above and around the top sub 80 and, the drill tube adapter 16 may also comprise a threated connection surface 17.

Figure 8:
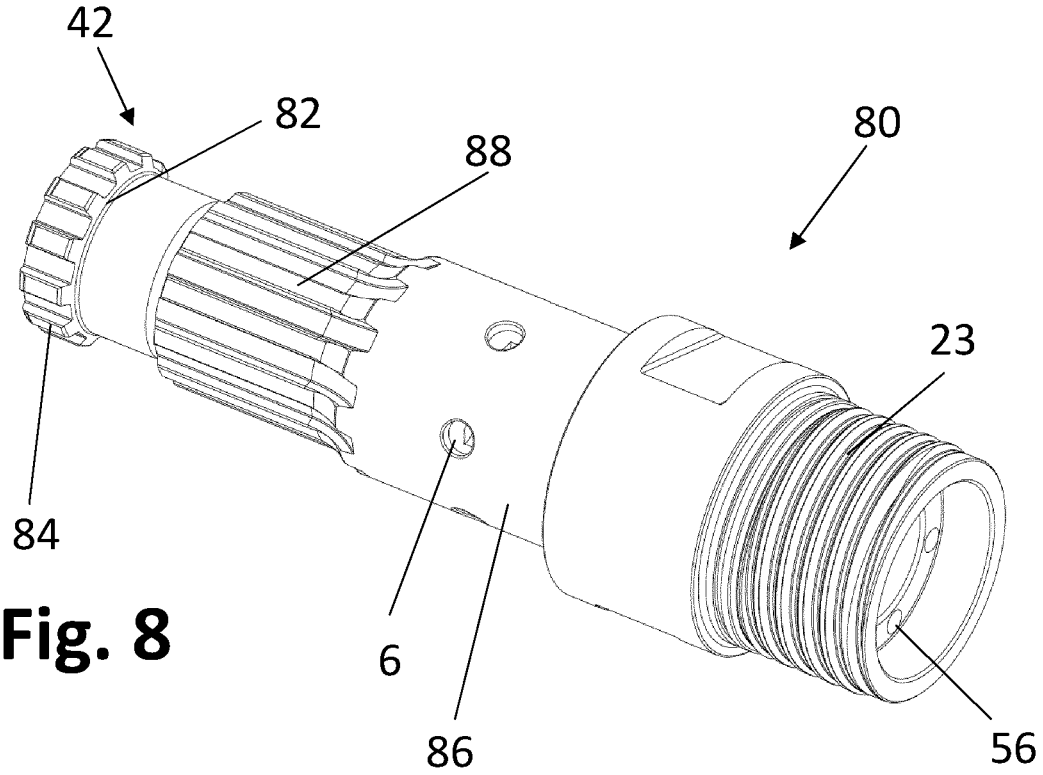
FIG. 8: shows a schematic drawing of the top sub.

The top sub 80 has an inlet port 18 for feeding pressurized fluid to an impact device 13. The drill tube adapter 16 comprises an air passage 34 (central bore in the drill tube adapter 16) that is connected to the air supply passage 26 of the top sub 80. The inlet port 18 may comprise a valve means **18*a*, which allows feeding of fluid towards the impact device but prevents flow in an opposite direction. FIG. 8 shows a schematic drawing of the top sub 80. At the top end 42 of the top sub 80 is a retaining shoulder 82 which extends axially outwards from the body of the top sub 80 and acts to retain the top sub 80 to an exhaust cover 46. In some embodiments the top sub 80 has a first bearing surface 84 towards the top end of the top sub 80, preferably positioned above the retaining shoulder 82 and a second bearing surface 86 positioned on the opposite side of the retaining shoulder 82 compared to the first bearing surface 84. The bearing surfaces 84, 86 are substantially cylindrical, the first bearing surface 84 has splines machined from the cylindrical surface. When combined the first and second bearing surfaces 84, 86 form a guidance feature which ensures that the exhaust valve remains correctly aligned so that it is able to either fully open or close the connection between the at least one exhaust passage and the at least one exhaust port when switching between drilling and flushing modes respectively. At least one exhaust passage 56 extends longitudinally through the top sub 80. The exhaust passage 56 connects to a top chamber 21 via at least one top vent passage 63 and then continues outwardly to engage with the exhaust cover 46. The top sub 80, moves with respect to the drill string 9, whereas the drill tube adapter 16 and exhaust cover 46 remain in a fixed position with respect to the drill string 9. The top sub 80 has a central bore 26 extending longitudinally through for the air supply to pass through. The top sub 80 further comprises at least one exhaust passage 56 which is located outside of the central bore and a valve 57 located on its periphery towards the exterior of the drilling assembly 11. The top sub 80 is threaded to the piston casing 15**.

The piston 19, which is substantially an elongated cylinder extends axially within the casing 15 and is capable of shuffling back and forth longitudinally through the DTH drilling assembly 11. At a bottom end 44 of the piston 19 is an impact surface ISA arranged to strike an impact surface ISB at a top end 42 of a drill bit 14. Optionally, the piston 19 is a solid-core piece, whereby it is without any through channels or openings in axial and transverse directions. At the top end 42 side of the piston 19 is the top working chamber 21 and at the opposite end side is a bottom working chamber 22. Movement of the piston 19 is configured to feed and discharge the working chambers 21, 22 and to thereby cause the piston 19 to move towards an impact direction A and return direction B.

At the top end 42 of the drilling assembly 11 is an exhaust system 58 which comprises an exhaust cover 46 and at least one exhaust port 55. The exhaust cover 46 is engaged with the drill tube adapter 16 by a threaded connection. A retaining ring 25 is positioned between the exhaust cover 46 and the tube adapter 16 (shown on FIG. 6) to limit the axial movement of the top sub 80. The at least one exhaust port 55 extends radially through the exhaust cover 46. The at least one exhaust port 55 is open to the exterior of the drilling assembly 11. The exhaust cover 46 and the top sub 80 are connected in a way so that that are able to slide together and apart longitudinally using an engaging feature, for example this could be done by means of a plurality of splines 88 positioned on the top sub 80. This means that torque can be transmitted from the exhaust cover 46 to the top sub 80 from the spline connection (not shown on drawing) or alternative engaging system whilst axial movement is limited.

The bottom chamber 22 is exhausted from the bottom end 44 of the drilling assembly through at least one flushing port 59 to remove cuttings from the drill bit face. The bottom chamber 22 is connected to the at least one flushing port 59 via at least one bottom vent passage 64. The top chamber 21 is fluidly connected to at least one top vent passage 63, which fluidly connects to the at least one exhaust passage 56 and then the top chamber 21 is exhausted through the at least one exhaust port 55 positioned in the exhaust cover 46.

The at least one exhaust port 55 is able to open and close when switched between drilling mode and flushing mode. When the drilling assembly 11 is switched from drilling mode to flushing mode, the exhaust system 58 is moved forward relative to the drill string 9. The opening and closing of the at least one exhaust port 55 is enabled by the presence of at least one exhaust valve 57 positioned on the top sub 80. When the drilling assembly 11 is in drilling mode the exhaust system 58 is located next to the drill string 9 and so the exhaust valve 57 is positioned so that the exhaust ports 55 are open, in other words the at least one exhaust port is in fluid connection with the at least one exhaust passage 56. When the drilling assembly 11 is in flushing mode the exhaust system 58 is positioned forward of the drill string 9 and therefore the at least one exhaust valve 57 is positioned so that the at least one exhaust port 55 is closed. By closing the at least one exhaust port 55 when the drilling assembly 11 is in flushing mode all the air is directed through the drill bit which improves the effectiveness of the hole cleaning and prevents contamination of the hammer. The at least one exhaust ports 55 in the exhaust cover 46 are opened and closed to the exterior of the drilling assembly 11 by the at least one exhaust valve 57.

Figure 5:
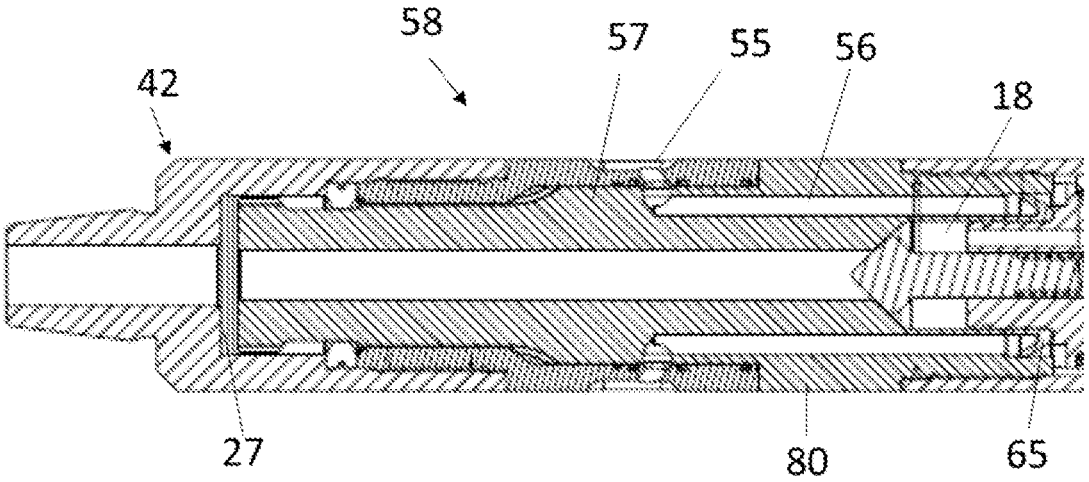
FIG. 5: shows an enlargement of the top end of the cross section of the DTH drilling assembly when in drilling mode.

FIG. 5 shows an enlargement of the top end 42 of the drilling assembly 11 when in drilling mode. In drilling mode, the at least one exhaust valve 57 is positioned so that the at least one exhaust passage 56 and the at least one exhaust port 55 are connected and so the pressurized fluid is exhausted to the exterior.

Figure 6:
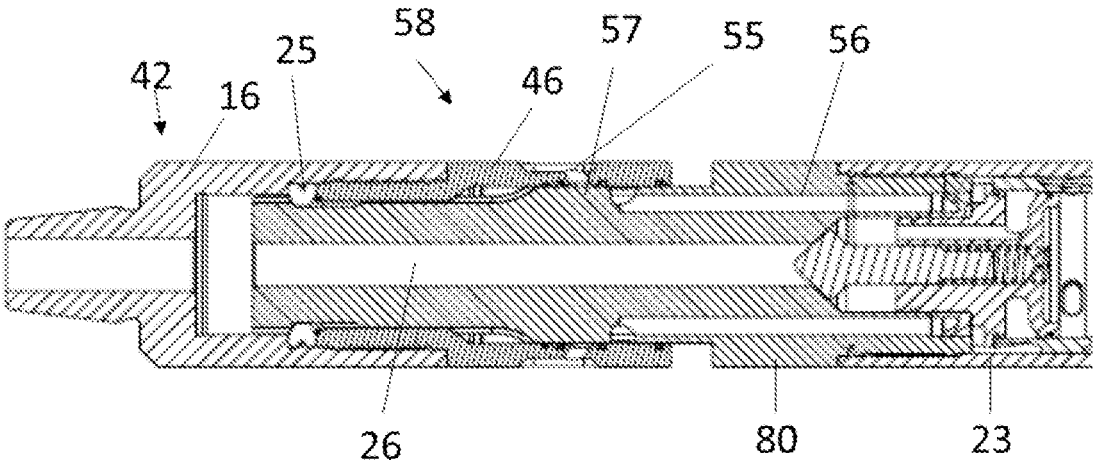
FIG. 6: shows an enlargement of the top end of the cross section of the DTH drilling assembly when in flushing mode.

FIG. 6 shows an enlargement of the top end 42 of the drilling assembly 11 when in flushing mode. In flushing mode, the at least one exhaust valve 57 is positioned so that the at least one exhaust port 55 is blocked off from the at least one exhaust passage 56. This means that all the flushing air is directed through the drill bit.

Figure 7:
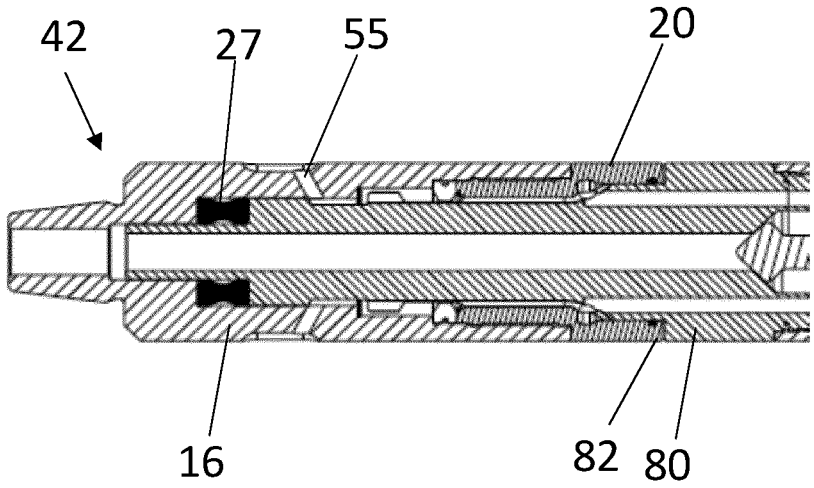
FIG. 7: shows an enlargement of the top end of the cross section of the DTH drilling assembly in drilling mode having a dampening device.

FIG. 7 shows that optionally, a damping device 27 may be added between the top sub 80 and the drill tube adapter 16. The damping device 27 or element must be suitable for absorbing shock and vibration caused from the drilling operation and could for example be made from an elastic material such as polyurethane or rubber.

Figure 9:
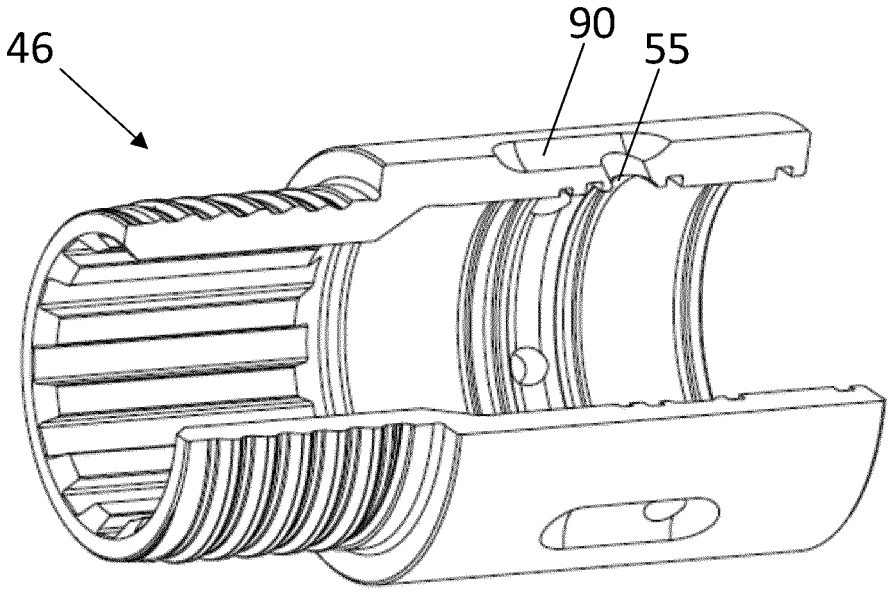
FIG. 9: shows a schematic drawing of the exhaust cover.
Figure 10:
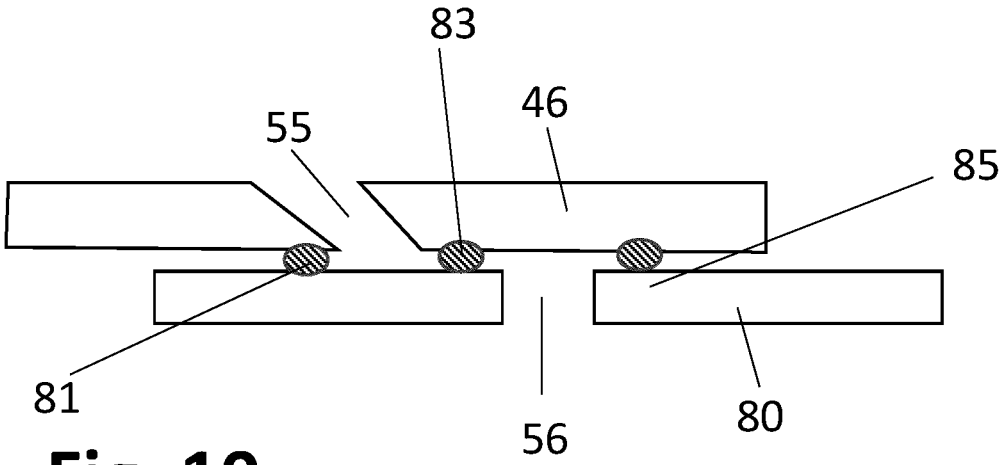
FIG. 10: shows a schematic drawing of seals surrounding the exhaust port in flushing mode.
Figure 11:
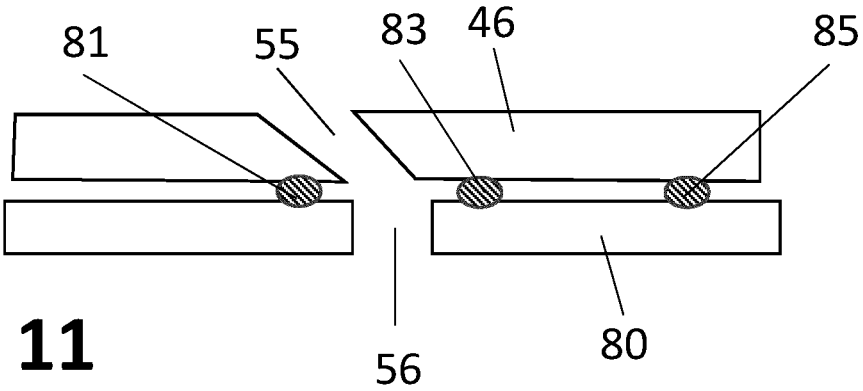
FIG. 11: shows a schematic drawing of seals surrounding the exhaust port in drilling mode.

FIGS. 10 and 11 show an enlargement of the interface between the exhaust cover 46 and the top sub 80 in flushing and drilling modes respectively wherein at least one seal 81,83,85 is positioned on both sides of the at least one exhaust port 55. Preferably the seals are scraper/washer seal type seals. In the example shown in FIGS. 9 and 10, three seals 81, 83, 85 are used. As shown in FIG. 10, when in flushing mode and the exhaust port 55 is closed the first seal 81 and the second seal 83 block off the sides of the exhaust port 55 and the second seal 83 and third seal 85 block off the sides of the exhaust passage 56 to prevent contamination from dirt and debris entering the drilling assembly 11. As shown in FIG. 11, when in drilling mode and the at least one exhaust port 55 is open, the first seal 81 and the second seal 83 block off the sides of the exhaust port 55 and exhaust passage 56 and in this position the third seal 85 is redundant.

FIG. 9 shows the exhaust cover 46. Optionally, there is a groove 90 or indention in the exhaust cover surrounding the exit of the exhaust port 55. Preferably, the groove 90 extends beyond both sides of the exhaust port 55 and has a curved radius. Optionally, the angle of the exhaust port 55 is inclined at an angle of ≥90° with respect to the longitudinal axis 2 of the drilling assembly 11 that is oriented towards the drill bit 14.

Optionally, there is a check valve 65 between the top chamber 21 and the at least one exhaust port 55. Preferably, the check valve 65 is made from a deformable rubber or with a spring.

The invention claimed is:

1. A down the hole drilling assembly having a top end arranged for coupling to a drill string and a bottom cutting end, the drilling assembly comprising:

a drill tube adapter positioned at the top end of the assembly;

an elongate casing;

a drill bit at least partially accommodated within the bottom end of the casing;

a fluid powered piston arranged moveably inside the casing to shuttle axially back and forth;

a top working chamber at a top end side of the piston;

a bottom working chamber at a bottom end side of the piston;

a top sub including a retaining shoulder, a plurality of splines, at least one exhaust passage engaged with the casing, wherein the at least one exhaust passage is connected to the top chamber via at least one top vent passage;

at least one flushing port at the bottom end of the casing and being connected to the at least one bottom vent passage arranged to vent the bottom chamber; and an exhaust system at the top end of the casing including an exhaust cover and at least one exhaust port arranged to vent the top chamber via the at least one exhaust passage, wherein the exhaust system is moveable with respect to the drill string and the top sub includes an exhaust valve arranged for opening and closing the connection between the at least one exhaust passage and the at least one exhaust port.

2. The down the hole drilling assembly according to claim 1, wherein the exhaust valve is positioned such that the connection between the at least one exhaust passage and the at least one exhaust port is open when the drilling assembly is in drilling mode.

3. The down the hole drilling assembly according to claim 1, wherein the exhaust valve is positioned such that the connection between the at least one exhaust passage and the at least one exhaust port is closed when the drilling assembly is in flushing mode.

4. The down the hole drilling assembly according to claim 1, further comprising an engaging feature, such as a spline connection, disposed between the exhaust cover and the top sub that allows the exhaust cover and top sub to slide longitudinally between a first position and a second position.

5. The down the hole drilling machine according to claim 1, further comprising at least one seal located on both sides of the at least one exhaust port.

6. The down the hole drilling machine according to claim 5, wherein the at least one seal comprises a minimum of 3 seals.

7. The down the hole drilling machine according to claim 1, further comprising a damping device positioned between the top sub and the drill tube adapter.

8. The down the hole drilling machine according to claim 1, wherein the top sub has a guidance feature.

9. The down the hole drilling machine, according to claim 1, further comprising a groove in the exhaust cover surrounding the at least one exhaust port.

10. The down the hole drilling machine according to claim 1, wherein the exhaust port is inclined at an angle of ≥90° with respect to the longitudinal axis of the drilling assembly that is oriented towards the drill bit.

11. The down the hole drilling machine, according to claim 1, wherein the fluid is fed to and is discharged from the working chambers via a plurality of fluid passages that are formed between the inner surface of the casing and the outer surface of the control sleeve.

12. The down the hole drilling machine, according to claim 1, further comprising a check valve between the top chamber and the exhaust port.

13. A drilling apparatus for percussive rock drilling, the drilling apparatus comprising:

a drill string formed from a plurality of end-to-end coupled drill tubes; and a drilling assembly as claimed in claim 1 releasably attached at an axially forward end of the drill string.

* * * * *